United States Patent [19]

Massaux et al.

[11] Patent Number: 4,772,413

[45] Date of Patent: Sep. 20, 1988

[54] NONAQUEOUS LIQUID NONBUILT LAUNDRY DETERGENT BLEACH BOOSTER COMPOSITION CONTAINING DIACETYL METHYL AMINE AND METHOD OF USE

[75] Inventors: Jean Massaux, Olne; Nunzio Mineo, Liege, both of Belgium; Leopold Laitem, Lebanon, N.J.

[73] Assignee: Colgate-Palmolive Company, New York, N.Y.

[21] Appl. No.: 901,222

[22] Filed: Aug. 28, 1986

[51] Int. Cl.[4] ..... C11D 3/39; C11D 3/30; C11D 1/66

[52] U.S. Cl. ..... 252/102; 8/137; 252/95; 252/104; 252/186.38; 252/174.21; 252/174.22; 252/DIG. 14

[58] Field of Search ..... 252/95, 99, 104, 174.21, 252/174.22, 174.16, 186.38, 102, DIG. 14; 8/107

[56] References Cited

U.S. PATENT DOCUMENTS

| | | | |
|---|---|---|---|
| 4,207,199 | 6/1980 | Perner et al. | 252/174.13 |
| 4,264,466 | 4/1981 | Carleton et al. | 252/99 |
| 4,541,944 | 9/1985 | Sanderson | 252/95 |
| 4,545,784 | 10/1985 | Sanderson | 8/107 |
| 4,622,173 | 11/1986 | Broze et al. | 252/528 |
| 4,647,393 | 3/1987 | Ouhadi et al. | 252/102 |
| 4,648,983 | 4/1987 | Broze et al. | 252/135 |
| 4,655,954 | 4/1987 | Broze et al. | 252/102 |
| 4,661,280 | 4/1987 | Ouhadi et al. | 252/99 |
| 4,690,771 | 9/1987 | Ouhadi et al. | 252/102 |

FOREIGN PATENT DOCUMENTS

| | | |
|---|---|---|
| 2158838 | 11/1985 | United Kingdom . |

*Primary Examiner*—Prince E. Willis

*Attorney, Agent, or Firm*—M. M. Grill; N. Blumenkopf

[57] ABSTRACT

A nonaqueous liquid nonbuilt laundry detergent bleach booster composition comprising a suspension or solution of diacetyl methyl amine (DAMA) organic liquid peroxy compound precursor in liquid nonionic surfactant. The bleach booster composition comprises a nonaqueous liquid nonionic surfactant containing a stable suspension or solution of diacetyl methyl amine (DAMA) and an anti-gel and viscosity control agent. The bleach booster composition is easily pourable and readily disperses on contact with water.

14 Claims, No Drawings

NONAQUEOUS LIQUID NONBUILT LAUNDRY DETERGENT BLEACH BOOSTER COMPOSITION CONTAINING DIACETYL METHYL AMINE AND METHOD OF USE

BACKGROUND OF THE INVENTION (1) Field of Invention

This invention relates to nonaqueous liquid fabric treating compositions. Particularly, this invention relates to nonaqueous liquid laundry detergent bleach booster compositions containing a suspension or solution of an organic liquid peroxy compound precursor in nonionic surfactants which bleach booster compositions are stable against phase separation and gelation and are easily pourable and to the use of these compositions as additives to built laundry detergent compositions containing inorganic per salt bleach compounds for cleaning soiled fabrics.

The invention more particularly relates to a nonaqueous liquid bleach booster composition especially adapted for boosting the removal of oxidisable and greasy and oily stains from textiles when added to conventional inorganic persalt containing liquid and powder detergent compositions.

(2) Discussion of Prior Art

Dry granular laundry bleach compositions are well known in the art. Built liquid and powder laundry detergent compositions containing inorganic persalt bleach compounds, such as perborates, are also well known. Pending applications assigned to the common assignee which disclose built liquid laundry detergent compositions containing inorganic persalt bleach compounds are:

Ser. No. 597,793, filed Apr. 6, 1984 describes a nonaqueous liquid nonionic surfactant detergent composition comprising a suspension of a builder salt and perborate bleach and containing an acid terminated nonionic surfactant (e.g., the reaction product of a nonionic surfactant and succinic anhydride) to improve dispersibility of the composition in an automatic washing machine.

Ser. No. 687,815, filed Dec. 31, 1984 describes a nonaqueous liquid nonionic surfactant detergent composition comprising a suspension of builder salt and perborate bleach and containing an alkylene glycol monoalkyl ether as a viscosity and gel control agent to improve dispersibility of the composition in an automatic washing machine.

Ser. No. 597,948, filed Apr. 9, 1984 describes a nonaqueous liquid nonionic surfactant detergent composition comprising a suspension of polyphosphate builder salt and perborate bleach and containing an alkanol ester of phosphoric acid to improve stability of the suspension against settling in storage.

Inorganic persalt compounds such as sodium perborate and sodium percarbonate are widely used in detergent compositions to give them bleaching properties.

These persalt compounds provide a satisfactory bleach performance when the detergent composition is used at the boil, but at lower temperatures their action is substantially nil. Bleaching improvement, however, has been obtained by the incorporation in the detergent composition of solid organic peroxy compound precursors such as tetra acetyl ethylene diamine (TAED), penta acetyl glucose (PAG) or tetra acetyl glycoluril (TAGU).

Though dry granular laundry bleach compositions have been the subject of diverse and detailed scrutiny, there has been little attention directed to liquid laundry bleach booster compositions.

Inorganic persalt bleach compound activators such as PAG and TAED are often compacted with starch to form granules to improve their stability in dry powder detergent compositions. In the wash liquor kinetics of the reaction between, e.g. perborate bleach and the PAG or TAED activator compacted granules are slow. The slow reaction (poor velocity) in generating per acetic acid leads to bleaching benefits lower than those which might be theoretically expected according to the activator (precursor) to perborate equivalent ratio. The use in dry powder compositions of a peracid such as Interox H 48, which is magnesium monoperoxyphthalate, has overcome to some extent the kinetics problems linked to active oxygen generation in powder bleach compositions. The H 48, however, is unstable in suspensions in liquid nonionic surfactants.

There is a ready commercial market for liquid bleach booster compositions. The liquid bleach booster compositions of the present invention are more convenient to employ than dry powdered or particulate products. They are readily measurable, speedily dissolved in the wash water, capable of being easily applied in concentrated solutions or dispersions to soiled areas on garments to be laundered and are non-dusting, and they usually occupy less storage space.

BRIEF DESCRIPTION OF THE INVENTION

The present invention relates to a nonaqueous liquid laundry bleach booster composition especially adapted for boosting the removal of oxidisable and greasy and oily stains from textiles when added to conventional inorganic persalt containing liquid and powder detergent compositions.

In accordance with the present invention a concentrated nonaqueous liquid non-built laundry detergent bleach booster composition is prepared by dispersing or dissolving an organic liquid peroxy compound precursor, e.g. diacetyl methyl amine (DAMA) in a liquid nonionic surfactant and anti-gel and viscosity control agent.

The diacetyl methyl amine (DAMA) compound used in accordance with the present invention is a known compound and has the formula

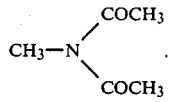

The inorganic persalt bleach compounds contained in the detergent compositions to which the bleach booster additive compositions are added are also known compounds.

The DAMA is water soluble and readily reacts with the conventionally used inorganic persalt bleach compounds to produce peracetic acid (PAA) a powerful bleaching agent.

The diacetyl methyl amine (DAMA) is an organic liquid peroxy compound precursor which in aqueous solution rapidly reacts with conventionally used inorganic persalt compounds, such as perborates, percarbonates, persulfates and perphosphates, to generate peracetic acid (PAA).

The persalt bleach compounds can be, for example, alkali metal perborates, percarbonates, perphosphates and persulfates. The sodium and potassium alkali metal salts are preferred.

In accordance with the present invention a stable suspension or solution of DAMA is a nonionic surfactant, which is pourable and readily dispersible in water, is obtained by adding the DAMA to a composition comprising a nonionic surfactant and an anti-gel and viscosity control agent.

In order to improve the viscosity characteristics of the composition and the storage properties of the composition there is added to the composition viscosity improving and anti-gel agents such alkylene glycol mono-alkyl ethers. To further improve the viscosity characteristics of the composition an acid terminated nonionic surfactant can be added. In an embodiment of the invention the detergent composition contains an alkylene glycol mono-alkyl ether and an acid terminated nonionic surfactant.

In addition, other ingredients can be added to the bleach booster composition such as optical brighteners, enzymes, peroxide stabilizers, perfume and dyes.

The presently manufactured washing machines for home use normally operate at washing temperatures of room temperature up to 100° C. Up to 18.6 gallons (70 liters) of water are used during the wash and rinse cycles.

About 20–40 gms of dry granular laundry bleach composition per wash are normally used.

In accordance with the present invention where the concentrated liquid bleach booster additive composition is used normally only about 15 gms or less of the booster composition are required.

Accordingly, in one aspect the present invention there is provided a liquid nonbuilt laundry detergent bleach booster additie composition composed of a suspension or solution of diacetyl methyl amine (DAMA) in liquid nonionic surfactant and anti-gel and viscosity control agent.

According to another aspect, the invention provides a concentrated liquid bleach booster composition which is stable, non-settling in storage and non-gelling in storage and in use. The liquid bleach booster compositions of the present invention are easily pourable, easily measured and easily put into the washing machine.

According to another aspect, the invention provides a method for washing laundry which comprises adding the liquid bleach booster composition to a built detergent composition in a washing machine or adding the booster composition to the laundry to be washed.

ADVANTAGES OVER THE PRIOR ART

The concentrated nonaqueous liquid nonionic nonbuilt laundry detergent bleach booster compositions containing diacetyl methyl amine (DAMA) suspended or dissolved in nonionic surfactant have the advantage over dry granular bleach compositions of reacting more rapidly when added to water to produce per acetic acid (PAA) and have improved pourability and dispersibility in water.

The concentrated nonaqueous liquid bleach booster additive compositions of the present invention have the added advantages of being stable, non-settling in storage, and non-gelling in storage. The liquid compositions are easily pourable, easily measured and easily added to the laundry detergent compositions and easily put into the laundry washing machines.

OBJECTS OF THE INVENTION

It is an object of the present invention to provide nonaqueous liquid laundry detergent bleach booster composition containing an organic liquid peroxy compound precursor suspended or dissolved in a nonionic surfactant.

It is another object of the invention to provide liquid bleach booster compositions which are suspensions or solutions of diacetyl methyl amine (DAMA) organic liquid peroxy compound precursor in a nonaqueous liquid nonionic surfactant and viscosity control and anti-gel agent which are storage stable, easily pourable and dispersible in cold, warm or hot water.

Another object of the invention is to provide a detergent bleach booster which enhances the rate of release of the peroxy compound precursor in the wash liquor relative to that achieved with the prior art granular products and to improve the rate of conversion into the organic peroxy bleaching compound, e.g. peracetic acid.

Another object of the invention is to provide a highly concentrated detergent bleach booster such that a relatively small amount of the booster is sufficient to significantly boost overall washing performance of a detergent composition containing a persalt compound, e.g. sodium perborate bleach.

Another object of the invention is to provide a highly concentrated detergent bleach booster which because it is readily water soluble can be used in detergent compositions containing persalt compounds in soaking and handwashing.

Another object os this invention is to provide a nongelling, stable suspension of nonaqueous liquid nonbuilt laundry detergent bleach booster composition which includes an effective amount of diacetyl methyl amine (DAMA) organic liquid peroxy compound precursor.

A further object of this invention is to provide nongelling, stable suspensions or solutions of nonaqueous liquid nonbuilt laundry detergent bleach booster composition which includes viscosity improving and anti-gel agents such as alkylene glycol mono-alkyl ethers and optionally a viscosity control agent which is an acid terminated nonionic surfactant.

These and other objects of the invention which will become more apparent from the following detailed description of preferred embodiments are generally provided for by preparing a nonaqueous nonbuilt laundry detergent bleach booster additive composition by adding to a nonaqueous liquid nonionic surfactant an effective amount of organic liquid peroxy compound precursor, e.g. diacetyl methyl amine (DAMA) and an anti-gel and viscosity improving agent, and inorganic or organic fabric treating additives, e.g. peroxide stabilizers, optical brighteners, enzymes, perfume and dyes.

The highly concentrated detergent bleach booster compositions of the present invention react quickly in aqueous wash liquor to provide improved bleach activity and generate PAA which is safe to use and harmless to colored items.

The highly concentrated detergent bleach booster compositions are easy to use, e.g. by adding it to the wash liquor through the dispenser or by putting an amount into the washer with the laundry to be washed.

NONIONIC SURFACTANT DETERGENT

The nonionic synthetic organic surfactant detergents employed in the practice of the invention may be any of a wide variety of such compounds, which are well known.

As is well known, the nonionic synthetic organic detergents are characterized by the presence of an organic hydrophobic group and an organic hydrophilic group and are typically produced by the condensation of an organic aliphatic or alkyl aromatic hydrophobic compound with ethylene oxide (hydrophilic in nature). Practically any hydrophobic compound having a carboxy, hydroxy, amido or amino group with a free hydrogen attached to the nitrogen can be condensed with ethylene oxide or with the polyhydration product thereof, polyethylene glycol, to form a nonionic detergent. The length of the hydrophilic or polyoxy ethylene chain can be readily adjusted to achieve the desired balance between the hydrophobic and hydrophilic groups. Typical suitable nonionic surfactants are those disclosed in U.S. Pat. Nos. 4,316,812 and 3,630,929.

Usually, the nonionic detergents are poly-lower alkoxylated lipophiles wherein the desired hydrophile-lipophile balance is obtained from addition of a hydrophilic poly-lower alkoxy group to a lipophilic moiety. A preferred class of the nonionic detergent employed is the poly-lower alkoxylated higher alkanol wherein the alkanol is of 9 to 18 carbon atoms and wherein the number of moles of lower alkylene oxide (of 2 or 3 carbon atoms) is from 3 to 12. Of such materials it is preferred to employ those wherein the higher alkanol is a higher fatty alcohol of 9 to 11 or 12 to 15 carbon atoms and which contain from 5 to 8 or 5 to 9 lower alkoxy groups per mole. Preferably, the lower alkoxy is ethoxy but in some instances, it may be desirably mixed with propoxy, the latter, is present, often being a minor (less than 50%) proportion.

Exemplary of such compounds are those wherein the alkanol is of 12 to 15 carbon atoms and which contain about 7 ethylene oxide groups per mole, e.g. Neodol 25-7 and Neodol 23-6.5, which products are made by Shell Chemical Company, Inc. The former is a condensation product of a mixture of higher fatty alcohols averaging about 12 to 15 carbon atoms, with about 7 moles of ethylene oxide and the latter is a corresponding mixture wherein the carbon atom content of the higher fatty alcohol is 12 to 13 and the number of ethylene oxide groups present averages about 6.5. The higher alcohols are primary alkanols.

Other examples of such detergents include Tergitol 15-S-7 and Tergitol 15-S-9, both of which are linear secondary alcohol ethoxylates made by Union Carbide Corp. The former is mixed ethoxylation product of 11 to 15 carbon atoms linear secondary alkanol with seven moles of ethylene oxide and the latter is a similar product but with nine moles of ethylene oxide being reacted.

Also useful in the present composition as a component of the nonionic detergent are higher molecular weight nonionics, such as Neodol 45-11, which are similar ethylene oxide condensation products of higher fatty alcohols, with the higher fatty alcohol being of 14 to 15 carbon atoms and the number of ethylene oxide groups per mole being about 11. Such products are also made by Shell Chemical Company.

Other useful nonionics are represented by the commercially well known class of nonionics sold under the trademark Plurafac. The Plurafacs are the reaction product of a higher linear alcohol and a mixture of ethylene and propylene oxides, containing a mixed chain of ethylene oxide and propylene oxide, terminated by a hydroxyl group. Examples include (A) a $C_{13}$–$C_{15}$ fatty alcohol condensed with 6 moles ethylene oxide and 3 moles propylene oxide, (B) a $C_{13}$–$C_{15}$ fatty alcohol condensed with 7 moles propylene oxide and 4 moles ethylene oxide, (C) a $C_{13}$–$C_{15}$ fatty alcohol condensed with 5 moles propylene oxide and 10 moles ethylene oxide, and (D) a mixture of equal parts of products (B) and (C).

Another group of liquid nonionics are commercially available from Shell Chemical Company, Inc. under the Dobanol trademark: Dobanol 91-5 is an ethoxylated $C_9$–$C_{11}$ fatty alcohol with an average of 5 moles ethylene oxide and Dobanol 25-7 is an ethoxylated $C_{12}$–$C_{15}$ fatty alcohol with an average of 7 moles ethylene oxide per mole of fatty alcohol.

Another useful group of nonionic surfactants are the "Surfactant T" series of nonionics available from British Petroleum. The Surfactant T nonionics are obtained by the ethoxylation of secondary $C_{13}$ fatty alcohols having a narrow ethylene oxide distribution. The Surfactant T5 has an average of 5 moles of ethylene oxide; Surfactant T7 an average of 7 moles of ethylene oxide; Surfactant T9 an average of 9 moles of ethylene oxide and Surfactant T12 an average of 12 moles of ethylene oxide per mole of secondary $C_{13}$ fatty alcohol.

In the compositions of this invention, preferred nonionic surfactants include the $C_{13}$–$C_{15}$ secondary fatty alcohols with relatively narrow contents of ethylene oxide in the range of from about 7 to 9 moles, and the C9 to C11 fatty alcohols ethoxylated with about 5–6 moles ethylene oxide.

Mixtures of two or more of the liquid nonionic surfactants can be used and in some cases advantages can be obtained by the use of such mixtures.

ACID TERMINATED NONIONIC SURFACTANT

The viscosity and gel properties of the bleach booster compositions can be improved by including in the composition an effective amount an acid terminated liquid nonionic surfactant. The acid terminated nonionic surfactants consist of a nonionic surfactant which has been modifed to convert a free hydroxyl group thereof to a moiety having a free carboxyl group, such as an ester or a partial ester of a nonionic surfactant and a polycarboxylic acid or anhydride.

As disclosed in the commonly assigned copending application Ser. No. 597,948 filed Apr. 9, 1984, the disclosure of which is incorporated herein by reference, the free carboxyl group modified nonionic surfactants, which may be broadly characterized as polyether carboxylic acids, function to lower the temperature at which the liquid nonionic forms a gel with water.

The addition of the acid terminated nonionic surfactants to the liquid nonionic surfactant aids in the dispensibility of the composition, i.e. pourability, the lowers the temperature at which the liquid nonionic surfactants form a gel in water without a decrease in their stability against settling. The acid terminated nonionic surfactant reacts in the washing machine water with the alkalinity of the dispersed builder salt phase of the detergent composition and acts as an effective anionic surfactant.

Specific examples include the half-esters of nonionic surfactant product (A) with succinic anhydride, the ester or half ester of Dobanol 25-7 with succinic anhydride, and the ester or half ester of Dobanol 91-5 with succinic anhydride. Instead of succinic anhydride, other polycarboxylic acids or anhydrides can be used, e.g.

maleic acid, maleic acid anhydride, citric acid and the like.

The acid terminated nonionic surfactants can be prepared as follows:

Acid Terminated Plurafac 30. 400 g of nonionic surfactant product (A) which is a $C_{13}$ to $C_{15}$ alkanol which has been alkoxylated to introduce 6 ethyleneoxide and 3 propylene oxide units per alkanol unit is mixed with 32 g of succinic anhydride and heated for 7 hours at 100° C. The mixture is cooled and filtered to remove unreacted succinic material. Infrared analysis indicated that about one half of the nonionic surfactant has been converted to the acidic half-ester thereof.

Acid Terminated Dobanol 25-7. 522 g of Dobanol 25-7 nonionic surfactant which is the product of ethoxylation of a $C_{12}$ to $C_{15}$ alkanol and has about 7 ethyleneoxide units per molecule of alkanol is mixed with 100 g of succinic anhydride and 0.1 g of pyridine (which acts as an esterification catalyst) and heated at 260° C. for 2 hours, cooled and filtered to remove unreacted succinic material. Infrared analysis indicates that substantially all the free hydroxyls of the surfactant have reacted.

Acid Terminate Dobanol 91-5. 1000 g of Dobanol 91-5 nonionic surfactant which is the product of ethoxylation of a $C_9$ to $C_{11}$ alkanol and has about 5 ethylene oxide units per molecule of alkanol is mixed with 265 g of succinic anhydride and 0.1 g of pyridine catalyst and heated at 260° C. for 2 hours, cooled and filtered and remove unreacted succinic material. Infrared analysis indicates that substantially all the free hydroxyls of the surfactant have reacted.

Other esterification catalysts, such as an alkali metal alkoxide (e.g. sodium methoxide) may be used in place of, or in admixture with, the pyridine.

The acidic polyether compound, i.e. the acid terminated nonionic surfactant is preferably added dissolved in the nonionic surfactant.

VISCOSITY CONTROL AND ANTI GEL AGENTS

The inclusion in the bleach booster composition of an effective amount of low molecular weight amphiphilic alkylene glycol mono-alkyl ether compounds which function as viscosity control and gel-inhibiting agents for the nonionic surfactant substantially improves the storage properties of the composition. The amphiphilic compounds can be considered to be analogous in chemical structure to the ethoxylated and/or propoxylated fatty alcohol liquid nonionic surfactants but have relatively short hydrocarbon chain lengths ($C_2$ to $C_8$) and a low content of ethylene oxide (about 2 to 6 ethylene oxide groups per molecule).

Suitable amphiphilic compounds can be represented by the following general formula $$RO(CH_2CH_2O)_nH$$

where R is a $C_2$–$C_8$ alkyl group, and n is a number of from about 1 to 6, on average.

Specifically the compounds are lower ($C_2$ to $C_3$) alkylene glycol mono lower ($C_2$ to $C_5$) alkyl ethers.

More specifically the compounds are mono di- or tri lower ($C_2$ to $C_3$) alkylene glycol mono lower ($C_1$ to $C_5$) alkyl ethers.

Specific examples of suitable amphiphilic compounds include ethylene glycol monoethyl ether ($C_2H_5$-O-$CH_2CH_2OH$), diethylene glycol monobutyl ether ($C_4H_9$-O-$(CH_2CH_2O)_2H$), tetraethylene glycol monobutyl ether ($C_4H_7$-O-$(CH_2CH_2O)_4H$) and dipropylene glycol monomethyl ether $$(CH_3-O-(CH_2\underset{\underset{CH_3}{|}}{C}HO)_2H).$$

Diethylene glycol monobutyl ether is especially preferred.

The inclusion in the composition of the low molecular weight lower alkylene glycol mono alkyl ether decreases the viscosity of the composition, such that it is more easily pourable, improves the stability against settling and improves the dispersibility of the composition on the addition to warm water or cold water. The alkylene glycol mono-alkyl ethers can also function as co-solvents for the organic liquid peroxy compound precursors, e.g. the diacetyl methyl amine (DAMA) and the nonionic surfactant.

The compositions of the present invention have improved viscosity and stability characteristics and remain stable and pourable at temperatures as low as about 5° C. and lower.

DETAILED DESCRIPTION OF INVENTION

The nonaqueous nonbuilt liquid laundry detergent bleach booster compositions of the present invention are especially adapted for boosting the removal of oxidisable and greasy and oily stains from textiles when added to conventional inorganic persalt containing detergent compositions.

The nonaqueous liquid nonbuilt laundry detergent bleach booster composition of the present invention has suspended or dissolved therein diacetyl methyl amine (DAMA) organic liquid peroxy compound precursor.

The present invention includes as an essential part of the composition an organic liquid peroxy compound precursor, e.g. diacetyl methyl amine (DAMA) and an anti-gel viscosity control agent.

The diacetyl methyl amine (DAMA) used in the bleach booster compositions of the present invention has the following formula

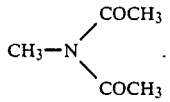

In accordance with the present invention a stable suspension or solution of DAMA in a nonionic surfactant detergent, which is pourable and readily dispersible in water is obtained by adding the DAMA to a composition comprising a nonionic surfactant and an anti-gel and viscosity control agent, e.g. an alkylene glycol mono-ether.

The diacetyl methyl amine (DAMA) is an organic liquid peroxy compound precursor which in aqueous solution rapidly reacts with conventional used inorganic persalt compounds, such as perborates, percarbonates, persulfates and perphosphates, to generate peracetic acid (PAA) a powerful bleaching agent.

When used in conjunction with a perborate containing detergent composition one gram of DAMA generates 0.66 g PAA. By comparison 1 g TAED, 1 g PAG and 1 g TAGU generate 0.67 g, 0.53 g and 0.49 g PAA, respectively.

The DAMA is stable in the absence of persalt compounds. The DAMA and the persalt compounds, however, must not come into contact with each other except when added to the wash water, e.g. in the washer or when used with a detergent to presoak textiles and/or to hand wash textiles.

Organic liquid precursor compounds that can be used in place of all or a part of the DAMA are ethylidene compounds of the formula

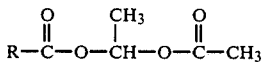

wherein $R=C_nH_{2n+1}$ and n=2 to 11, or phenyl or substituted phenyl. R is preferably $C_4$ to $C_{11}$ alkyl and more preferably $C_6$ to $C_9$ alkyl, or phenyl, or methyl or ethyl substituted phenyl. A preferred compound is ethylidene benzoate acetate.

Other organic liquid peroxy precursor compounds that can be used in place of the DAMA are ethylidene carboxylate acetate and alkyl and alkenyl succinic anhydride carboxylate acetate and its salts and alkyl and alkenyl succinic anhydride.

There can also be used as the organic peroxy precursor compound solid compounds which are readily dispersed and/or soluble in the nonionic surfactant and anti-gel and viscosity control agent liquid system. Suitable solid peroxy precursor compounds that can be used are tetra acetyl ethylene diamine (TAED), penta acetyl glucose (PAG) and tetra acetyl glycoluril (TAGU).

DETERGENT COMPOSITIONS

The detergent compositions to which the bleach booster composition of the present invention is added can contain anionic, nonionic and cationic and amphoteric surfactant detergents and mixtures thereof. The detergent compositions can be aqueous or nonaqueous liquids or can be dry powder compositions.

The nonionic surfactant detergents that can be used in the detergent composition can be those discussed above.

Examples of anionic detergents that can be used are the conventional water-soluble salts, particularly alkali metal salts of sulfate ethers or sulfonates containing higher aliphatic hydrocarbon radicals of 8 or more carbon atoms (e.g. 8–22 carbon atoms); such as sodium or potassium sulfates of higher alcohols (e.g. sulfates of alkanols such as coco alcohol or sulfates or other higher alcohols such as the higher alkyl phenol-ethylene oxide ether sulfates or the higher fatty acid monoglyceride sulfates or the ethoxylated higher fatty alcohol sulfates), sodium or potassium salts of higher sulfonic acids (e.g. of higher alkylbenzene sulfonic acids such as pentadecyl benzene sulfonic acid, or of isothionate esters of higher fatty acids such as coconut oil fatty acids).

Examples of cationic detergents that can be used are the conventional quaternary ammonium compounds in which there is a quaternary nitrogen atom directly linked to a carbon atom of a hydrophobic radical of at least ten carbon atoms (e.g. a long chain alkyl radical or an alkylaryl radical, in which there are 10–20 carbon atoms), three valences of the nitrogen atom being also directly linked to other carbon atoms which may be in separate radicals such as alkyl, particularly lower alkyl, or aralkyl radicals) or in a cyclic structure including the quaternary nitrogen atom (as in a morpholine, pyridine, quinoline or imidazoline ring); stearyl trimethyl ammonium chloride being a specific example.

Examples of amphoteric detergent that can be used are the conventional tertiary amine oxides having a hydrophobic radical (such as hydrocarbon radical of 10–18 carbon atoms) attached to the nitrogen atom (e.g. lauryl dimethyl amine oxide). Other examples are amino acids having a similar hydrophobic radical attached to the nitrogen atom of the amino acid (e.g. N-lauryl aminopropionic acid).

The detergent compositions will contain an inorganic oxygen bleach compound. Oxygen bleaches are represented by percompounds which liberate hydrogen peroxide in solution. Preferred examples include sodium and potassium perborates, percarbonates, and perphosphates, and potassium monopersulfate. The perborates, particularly sodium perborate monohydrate, are especially preferred.

The detergent compositions to which the bleach booster composition of the present invention are added (e.g. in the wash liquor) can include water soluble and/or water insoluble detergent builder salts. Water soluble inorganic alkaline builder salts which can be used alone with the detergent composition or in admixture with other builders are alkali metal carbonates, bicarbonates, borates, phosphates, polyphosphates, and silicates. (Ammonium or substituted ammonium salts can also be used.) Examples of conventionally used builder salts are sodium tripolyphosphate, sodium carbonate, sodium tetraborate, sodium pyrophosphate, potassium pyrophosphate, sodium bicarbonate, potassium tripolyphosphate, sodium and potassium bicarbonate. Sodium tripolyphosphate (TPP) is a commonly used builder salt.

The alkali metal silicates are useful builder salts which also function to adjust or control the pH and to make the composition anticorrosive to washing machine parts. Sodium silicates of $Na_2O/SiO_2$ ratios of from 1.6/1 to 1/3.2, especially about 1/2 to 1/2.8 are preferred. Potassium silicates of the same ratios can also be used. A preferred alkali metal silicate is sodium disilicate.

Since the detergent compositions are generally highly concentrated, and, therefore, may be used at relatively low dosages, it can be desirable to supplement the inorganic builder salts with an auxiliary builder such as an alkali metal lower polycarboxylic acid having high calcium and magnesium binding capacity to inhibit incrustation which could otherwise be caused by formation of insoluble calcium and magnesium salts. Suitable alkali metal polycarboxylic acids are alkali metal salts of citric and tartaric acid, e.g., monosodium citrate (anhydrous), trisodium citrate, glutaric acid salt, glutonic acid salt and diacid salt with a longer chain.

Other organic builders are polymers and copolymers of polyacrylic acid and polymaleic anhydride and the alkali metal salts thereof. More specifically such builder salts can consist of a copolymer which is the reaction product of about equal moles of methacrylic acid and maleic anhydride which has been completely neutralized to form the sodium salt thereof. The builder is commercially available under the tradename of Sokalan CP5. This builder serves when used even in small amounts of inhibit incrustation.

Examples of organic alkaline sequestrant builder salts which can be used with the detergent builder salts or in admixture with other organic and inorganic builders are alkali metal, ammonium or substituted ammonium, aminopolycarboxylates, e.g. sodium and potassium ethylene diaminetetraaceatate (EDTA), sodium and potassium nitrilotriacetates (NTA), and triethanolammonium N-(2-hydroethyl)nitrilodiacetates. Mixed salts of these aminopolycarboxylates are also suitable.

Other typical suitable builders include, for example, those disclosed in U.S. Pat. Nos. 4,316,812, 4,264,466 and 3,630,929. The inorganic alkaline builder salts can be used with the nonionic surfactant detergent compound or in admixture with other organic or inorganic builder salts.

STABILIZING AGENTS

The physical stability of particles suspended in built liquid detergent compositions can be improved by the presence of a stabilizing agent which is an alkanol ester of phosphoric acid.

Improvements in stability of the detergent composition may be achieved in certain formulations by incorporation of a small effective amount of an acidic organic phosphorus compound having an acidic —POH group, such as a partial ester of phosphorous acid and an alkanol.

As disclosed in the commonly asigned copending application Ser. No. 597,948 filed Apr. 9, 1984 the disclosure of which is incorporated herein by reference, the acidic organic phosphorus compound having an acidic —POH group can increase the stability of the suspension of builders in the nonaqueous liquid nonionic surfactant.

The acidic organic phosphorus compound may be, for instance, a partial ester of phosphoric acid and an alcohol such as an alkanol which has a lipophilic character, having, for instance, more than 5 carbon atoms, e.g. 8 to 20 carbon atoms.

A specific example is a partial ester of phosphoric acid and a $C_{16}$ to $C_{18}$ alkanol (Empiphos 5632 from Marchon); it is made up of about 35% monoester and 65% diester.

The inclusion of quite small amounts of the acidic organic phosphorus compound makes the suspension significantly more stable against settling on standing but remains pourable, while, for the low concentration of stabilizer, e.g. below about 1%, its plastic viscosity will generally decrease.

The acidic organic phosphorus stabilizer compound can optionally be added to the bleach booster composition to improve the stability of the suspension in the bleach booster composition.

The detergent composition may in some cases contain an activator for the peroxygen compound which activator can lower the effective operating temperature of the peroxide bleaching agent.

The bleach activators are, however, not required in the detergent composition to carry out the present invention. The diacetyl methyl amine (DAMA) in the bleach booster additive composition of the present invention performs the function of the bleach activator normally present in some detergent compositions.

The detergent compositions can also include a sequestering agent of high complexing power to inhibit any undesired reaction between such peroxyacid and hydrogen peroxide in the wash solution in the presence of metal ions.

Suitable sequestering agents for this purpose include sodium salts of nitrilotriacetic acid (NTA), ethylene diamine tetraacetic acid (EDTA), diethylene triamine pentaacetic acid (DEPTA), diethylene triamine pentamethylene phosphonic acid (DTPMP) sold under the tradename Dequest 2066; and ethylene diamine tetramethylene phosphonic acid (EDITEMPA). The sequestering agents can be used alone or in admixture.

In order to avoid loss of peroxide bleaching agent, e.g. sodium perborate, resulting from enzyme-induced decomposition, such as by catalase enzyme, the detergent compositions or bleach booster composition may include a peroxide stabilizing compound, i.e. a compound capable of inhibiting enzyme-induced decomposition of the peroxide bleaching agent. Suitable inhibitor compounds are disclosed in U.S. Pat. No. 3,606,990, the relevant disclosure of which is incorporated herein by reference.

Of special interest as the inhibitor compound, mention can be made of hydroxylamine sulfate and other water-soluble hydroxylamine salts. In the preferred nonaqueous compositions of this invention, suitable amounts of the hydroxylamine salt inhibitors can be as low as about 0.01 to 0.4%. Generally, however, suitable amounts of enzyme inhibitors are up to about 15%, for example, 0.1 to 10%, by weight of the composition.

In addition to the detergent builders, various other detergent additives or adjuvants may be present in the detergent composition to give it additional desired properties, either of functional or aesthetic nature. Thus, there may be included in the formulation, minor amounts of soil suspending or anti-redeposition agents, e.g. polyvinyl alcohol, fatty amides, sodium carboxymethyl cellulose, hydroxy-propyl methyl cellulose. A preferred anti-redeposition agent is sodium carboxymethyl cellulose having a 2:1 ratio of CMC/MC which is sold under the tradename Relatin DM 4050.

Optical brighteners for cotton, polyamide and polyester fabrics are usually included in the detergent composition, but can be added to the bleach booster composition. Suitable optical brighteners include stilbene, triazole and benzidine sulfone compositions, especially sulfonated substituted triazinyl stilbene, sulfonated naphthotriazole stilbene, benzidene sulfone, etc., most preferred are stilbene and triazole combinations. Preferred brighteners are Stilbene Brightener N4 which is a dimorpholino dianilino stilbene sulfonate and Tinopal ATS-X which is well known in the art.

Enzymes, preferably proteolytic enzymes, such as subtilisin, bromelin, papain, trypsin and pepsin, as well as amylase type enzymes, lipase type enzymes, and mixtures thereof are usually included in the detergent composition, but can be added to the bleach booster composition. Preferred enzymes include protease slurry, esperase slurry and amylase. A preferred enzyme is Esperse SL8 which is a protease. Anti-foam agents, e.g. silicon compounds, such as Silicane L 7604 can also be added in small effective amounts.

Bactericides, e.g. tetrachlorosalicylanilide and hexachlorophene, fungicides, dyes, pigments (water dispersible), preservatives, ultraviolet absorbers, anti-yellowing agents, such as sodium carboxymethyl cellulose, pH modifiers and pH buffers, color safe bleaches can be added to the detergent compositions. Perfume, and dyes and bluing agents such as ultramarine blue can be used in either or both of the detergent composition and bleach booster composition.

Typical surfactant detergent composition to which the nonaqueous liquid nonbuilt bleach booster additive composition of the present invention can be added are as follows.

| Formulation I (Nonaqueous Liquid Nonionic Surfactant Detergent Composition) | Weight % |
|---|---|
| Nonionic surfactant product (D) | 15.5 |
| Surfactant T 7 | 9.0 |
| Surfactant T 9 | 9.0 |
| Acid terminated Dobanol 91-5 reaction product with succinic anhydride | 6.0 |
| Sodium tripolyphosphate | 34.1 |
| Diethylene glycol monobutyl ether | 9.0 |
| Alkanol phosphoric acid ester (Empephos 5632) | 0.3 |
| Anti-incrustation agent (Sokalan CP-5) | 3.0 |
| Sodium perborate monohydrate bleaching agent | 10.0 |
| Sequestering agent (Dequest 2066) | 1.0 |
| Optical brightener (Tinopal ATS-X) | 0.5 |
| Anti-redeposition agent (Relatin DM 4050) | 1.0 |
| Esperase slurry (Esperase SL8) | 1.0 |
| Perfume | 0.5925 |
| Dye | 0.0075 |
| | 100.00 |

| Formulation II (A Dry Powder Detergent Composition) | Weight. % |
|---|---|
| Sodium $C_{12}$–$C_{18}$ alkyl benzene sulfonate | 20.0 |
| Sodium tripolyphosphate | 39.0 |
| Carboxymethyl cellulose | 1.0 |
| Sodium meta silicate | 10.0 |
| Sodium perborate monohydrate bleaching agent | 10.0 |
| Sodium sulfate | 20.0 |
| | 100.0 |

In the nonaqueous liquid nonbuilt laundry detergent bleach booster compositions of the invention, typical proportions (percent based on the total weight of composition, unless otherwise specified) of the ingredients are as follows:

Liquid nonionic surfactant detergent in the range of about 10 to 70, such as 20 to 70 and 30 to 60 percent.

Organic liquid peroxy compound, e.g. diacetyl methyl amine (DAMA) organic liquid peroxy compound precursor in the range of about 5 to 60, such as 10 to 50 and 20 to 40.

Alkylene glycol monoalkylether anti-gel agent in an amount in the range of about 5 to 20, such as 5 to 15 and 6 to 12 percent.

Acid terminated nonionic surfactant may be omitted, it is preferred however that it be added to the composition in an amount in the range of about 0 to 30, such as 5 to 25 and 5 to 15 percent.

Optical brightener in the range of about 0 to 2.0, such as 0.05 to 1.5 and 0.3 to 1.0 percent.

Enzymes in the range of about 0 to 3.0, such as 0.5 to 2.0 and 0.5 to 1.5 percent.

Perfume in the range of about 0 to 2.0, such as 0.10 to 1.25 and 0.5 to 1.0 percent.

Dye in the range of about 0 to 1.0, such as 0.0025 to 0.050 and 0.0025 to 0.0100 percent.

Various of the previously mentioned additives can optionally be added to achieve the desired function of the added materials.

Mixtures of the acid terminated nonionic surfactant and the alkylene glycol alkyl ether anti-gel agents can be used and in some cases advantages can be obtained by the use of such mixtures.

In the selection of the additives to the bleach booster composition, they will be chosen to be compatible with the organic liquid peroxy compound, nonionic surfactant and anti-gel and viscosity control agent constituents of the bleach booster composition.

In this application, as mentioned above, all proportions and percentages are by weight of the entire formulation or composition unless otherwise indicated.

The concentrated nonaqueous nonionic liquid bleach booster composition of the present invention dispenses readily in the water in the washing machine. The presently used home washing machines normally use 225 gms of powder bleach composition. In accordance with the present invention only about 15 ml or about 15 gms of bleach booster additive are needed.

In a preferred embodiment of the invention the bleach booster additive composition of a typical formulation is formulated using the below named ingredients:

| | Weight % |
|---|---|
| Nonionic surfactant detergent | 20–70 |
| Organic liquid peroxy compound, e.g. diacetyl methyl amine (DAMA) | 10–50 |
| Alkylene glycol monoalkyl ether | 6–12 |
| Acid terminated nonionic surfactant | 0–15 |
| Optical brightener (ATS-X) | 0–1.0 |
| Enzymes (Protease-Esperase SL8) | 0–1.5 |
| Perfume | 0–1.0 |

The present invention is further illustrated by the following examples.

EXAMPLE 1

A concentrated nonaqueous liquid nonbuilt nonionic surfactant bleach booster composition was formulated from the following ingredients in the amounts specified.

| | Weight % |
|---|---|
| Surfactant T 7 | 32 |
| Surfactant T 9 | 32 |
| Diacetyl methyl amine (DAMA) peroxy compound precursor | 29 |
| Diethylene glycol monobutyl ether | 7.0 |
| | 100.0 |

EXAMPLE 2

A concentrated nonaqueous liquid nonbuilt nonionic surfactant bleach booster composition is formulated from the following ingredients in the amount specified.

| | Weight. % |
|---|---|
| Surfactant T 7 | 29.3 |
| Surfactant T 9 | 29.3 |
| Diacetyl methyl amine (DAMA) peroxy compound precursor | 28.3 |
| Acid terminated Dobanol 91-5 reaction product with succinic anhydride | 4.0 |
| Diethylene glycol monobutyl ether | 7.0 |
| Optical brightener (Tinopal ATS-X) | 0.5 |
| Esperase slurry (Esperase SL8) | 1.0 |
| Perfume | 0.5925 |
| Dye | 0.0075 |
| | 100.00 |

EXAMPLE 3

A concentrated nonaqueous liquid nonbuilt nonionic surfactant bleach booster composition is formulated from the following ingredients in the amount specified.

| | Weight. % |
|---|---|
| Surfactant T 7 | 30.3 |
| Surfactant T 9 | 30.3 |
| Ethylidene benzoate acetate | 26.3 |
| Acid terminated Dobanol 91-5 reaction product with succinic anhydride | 4.0 |
| Diethylene glycol monobutyl ether | 7.0 |
| Optical brightener (Tinopal ATS-X) | 0.5 |
| Esperase slurry (Esperase SL8) | 1.0 |
| Perfume | 0.5925 |
| Dye | 0.0075 |
| | 100.00 |

The nonaqueous liquid nonbuilt bleach booster compositions of the present invention can advantageously be added to nonaqueous and aqueous nonionic, anionic, cationic and amphoteric surfactant liquid and powder detergent compositions containing inorganic persalt bleach compounds.

The addition in the wash liquor in a washing machine of the bleach booster compositions of Examples 1 or 2 to the detergent compositions of formulation I or II is found to substantially improve the removal of oxidisable and greasy and oily stains from textiles as compared to the use of the formulations I or II alone. The addition of the booster composition of Example 3 to the detergent composition of formulation I is found to substantially improve the bleach properties of the formulation.

It is understood that the foregoing detailed description is given merely by way of illustration and that variations may be made therein without departing from the spirit of the invention.

What is claimed is:

1. A concentrated nonaqueous liquid nonbuilt nonionic surfactant bleach booster composition which comprises Nonionic surfactant in an amount of about 20–70%

Diacetyl methyl amine in an amount of about 20–40%

Alkylene glycol monobutyl ether in an amount of about 6–12%.

2. The bleach booster composition of claim 1 comprising a polycarboxylic acid terminated nonionic surfactant in an amount of about 5–15% optical brightener in an amount of about 0.3–1.0% enzymes in an amount of about 0.5–1.5% perfume in an amount of about 0.5–1.0%.

3. A method for cleaning soiled fabrics which comprises adding to an aqueous wash liquor the bleach booster composition of claim 1 and a built nonaqueous liquid nonionic surfactant detergent composition comprising sodium perborate monohydrate bleach compound.

4. A method for cleaning soiled fabrics which comprises adding to an aqueous was liquor the bleach booster composition of claim 1 and a built powder detergent composition comprising an inorganic persalt bleach compound which is a member selected from the group consisting of an alkali metal perborate, percarbonate, perphosphate and persulfate.

5. The method of claim 4 wherein the inorganic persalt compound is alkali metal perborate monohydrate.

6. A concentrated nonaqueous liquid nonionic surfactant bleach booster composition which comprises liquid nonionic surfactant in an amount of about 10–70% diacetyl methyl amine in an amount of about 5–60%.

7. The bleach booster composition of claim 6 comprising an alkylene glycol monoalkyl ether anti-gel and viscosity control agent in an amount of about 5 to 20%.

8. The bleach booster composition of claim 6 comprising nonionic surfactant in an amount of about 20 to 70% diacetyl methyl amine in an amount of about 10 to 50% an alkylene glycol monoalkyl ether anti-gel and viscosity control agent in an amount of about 5 to 15% a polycarboxylic acid terminated nonionic surfactant viscosity control agent in an amount of about 0 to 30%.

9. The bleach booster composition of claim 8 comprising a polycarboxylic acid terminated nonionic surfactant viscosity control agent in an amount of about 5–25%.

10. A method for cleaning soiled fabrics which comprises adding to an aqueous wash liquor the bleach booster composition of claim 6 and a built detergent composition comprising an inorganic persalt bleach compound.

11. The method of claim 10 for cleaning soiled fabrics wherein the detergent composition comprises an inorganic persalt bleach compound which is a member selected from the group consisting of an alkali metal perborate, percarbonate, perphosphate and persulfate.

12. A method for cleaning soiled fabrics which comprises adding to an aqueous wash liquor the bleach booster composition of claim 6 and a built detergent composition comprising an inorganic alkali metal perborate monohydrate bleach compound.

13. A concentrated nonaqueous liquid nonbuilt nonionic surfactant bleach booster composition which consists essentially of at least one liquid nonionic surfactant in an amount of about 10 to 70% an alkylene glycol monoalkyl ether anti-gel and viscosity control agent in an amount of about 5 to 20% and diacetyl methyl amine dispersed or dissolved therein in an amount of about 5 to 60%.

14. The bleach booster composition of claim 13 comprising 10 to 50 percent of diacetyl methyl amine.

* * * * *